US008779985B2

(12) United States Patent
Oh

(10) Patent No.: US 8,779,985 B2
(45) Date of Patent: Jul. 15, 2014

(54) DUAL RADIATOR MONOPOLE ANTENNA

(75) Inventor: Sung Hoon Oh, Sunnyvale, CA (US)

(73) Assignee: QUALCOMM Incorporated, San Diego, CA (US)

( * ) Notice: Subject to any disclaimer, the term of this patent is extended or adjusted under 35 U.S.C. 154(b) by 300 days.

(21) Appl. No.: 13/212,316

(22) Filed: Aug. 18, 2011

(65) Prior Publication Data

US 2013/0044030 A1 Feb. 21, 2013

(51) Int. Cl.
*H01Q 1/38* (2006.01)

(52) U.S. Cl.
USPC ..... 343/700 MS

(58) Field of Classification Search
CPC ..... H01Q 1/38; H01Q 9/0407; H01Q 9/0421; H01Q 1/243; H01Q 5/0003
USPC ..... 343/702, 700 MS, 720, 843
See application file for complete search history.

(56) References Cited

U.S. PATENT DOCUMENTS 6,348,899 B1 * 2/2002 Bergstein ..... 343/890
6,452,561 B1 * 9/2002 West et al. ..... 343/772
6,650,294 B2 11/2003 Ying et al.
7,315,289 B2 1/2008 Puente Baliarda et al.
7,339,531 B2 * 3/2008 Desclos et al. ..... 343/702
7,498,896 B2 * 3/2009 Shi ..... 333/26
7,903,039 B2 3/2011 Yu
8,102,327 B2 * 1/2012 Johnson ..... 343/803
8,134,517 B2 * 3/2012 Wang et al. ..... 343/846

FOREIGN PATENT DOCUMENTS

TW 201037896 10/2010
WO WO-2005062422 7/2005

* cited by examiner

*Primary Examiner* — Huedung Mancuso
(74) *Attorney, Agent, or Firm* — Mahamedi Paradice LLP

(57) ABSTRACT

A dual radiator monopole antenna. An elongated low-band ground-coupled arm is disposed on a first surface of a printed circuit board. This arm is electrically connected to and spaced apart from a ground plane. An elongated high-band ground-coupled arm is disposed on a second surface of the printed circuit board, and like the low-band arm is electrically connected to and spaced apart from the ground plane. The high-band arm is oriented parallel to, and laterally displaced from, the low-hand ground-coupled ann. An elongated feed arm is disposed on the first surface of the printed circuit board, oriented parallel the ground-coupled arms and laterally displaced from them. A conductor in electrical feed connection with the feed arm extends from the feed arm across a portion of the ground plane.

20 Claims, 8 Drawing Sheets

DUAL RADIATOR MONOPOLE ANTENNA

BACKGROUND

Current and next-generation wireless handsets need wide-band, multi-band antennas. This need is becoming particularly acute with the spreading adoption of fourth-generation long-term evolution (4G LTE) technology. Antenna bandwidth requirements have increased with this technology because the 700 megahertz (MHz) frequency bands are specified for 4G LTE. In addition, any such antenna must fit within the enclosure of a mobile telephone.

BRIEF DESCRIPTION OF THE DRAWINGS

The drawings illustrate by example aspects and implementations of the invention.

DETAILED DESCRIPTION

Figure 1:
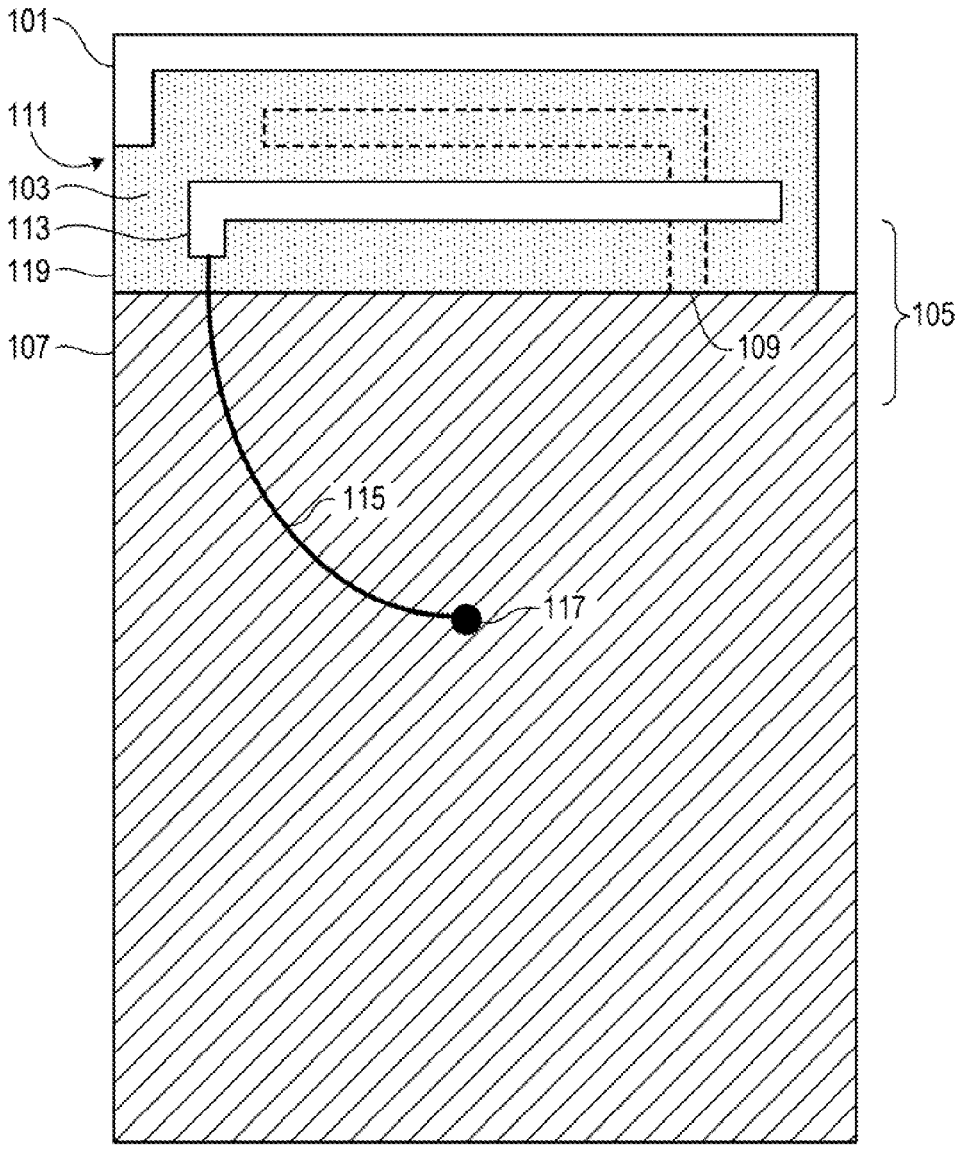
FIG. 1 is a top view of a printed circuit board including an antenna according to principles of the invention.

In the drawings and in this description, examples and details are used to illustrate principles of the invention. However, other configurations may suggest themselves, and the invention may be practiced without limitation to the details and arrangements as described. Some known methods and structures have not been described in detail in order to avoid obscuring the invention. The invention is to be limited only by the claims, not by the drawings or this description.

Any dimensions are approximate. Terms of orientation such as "top" and "bottom" are used only for convenience to indicate spatial relationships of components with respect to each other; unless otherwise indicated, orientation is not critical to proper functioning of the invention. In the drawings and in this description, the same reference numerals will be used throughout to refer to the same or like parts.

Figure 2:
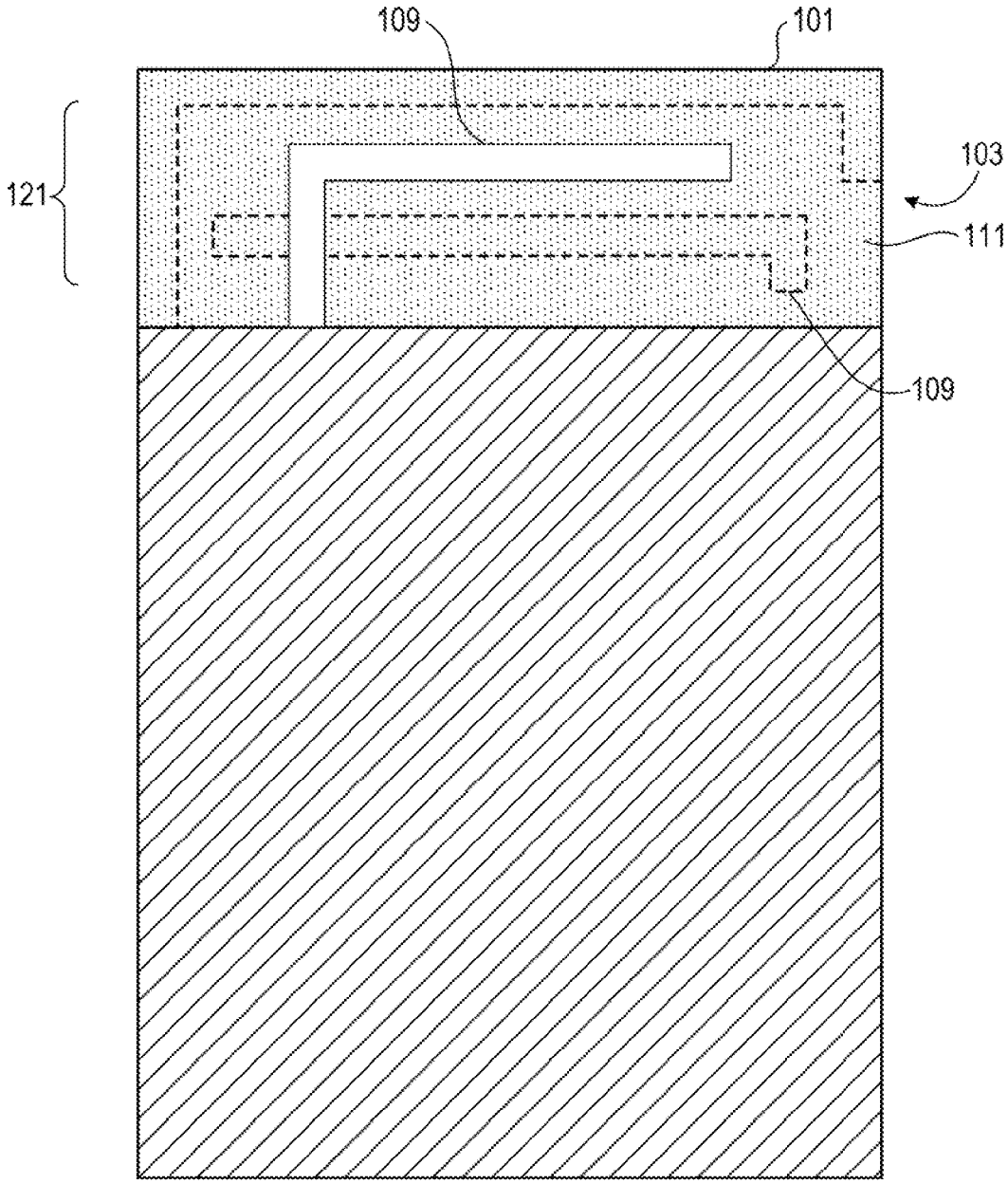
FIG. 2 is a bottom view of the printed circuit board of FIG. 1.

There is a need for an antenna that can fit within the confines of a portable appliance such as a mobile phone and that is operable both in existing frequency bands and in the new 4G LTE 700 MHz frequency bands. Referring to FIGS. 1 and 2, a dual radiator monopole antenna according to principles of the invention comprises an elongated low-band ground-coupled arm 101 disposed on a first surface 103 of a printed circuit board 105. The arm 101 is electrically connected to and spaced apart from a ground plane 107. An elongated high-band ground-coupled arm 109 is disposed on a second surface 111 of the printed circuit board, electrically connected to and spaced apart from the ground plane, oriented parallel the low-band ground-coupled arm 101, and laterally displaced therefrom. An elongated feed arm 113 is disposed on the first surface of the printed circuit board, oriented parallel the ground-coupled arms and laterally displaced therefrom. A conductor 115 is in electrical feed connection with the feed ann. The conductor extends from the feed arm across a portion of the ground plane 107.

The conductor may connect at a connection point 117 to an electronic component (not shown) carried by the printed circuit board, or the conductor may extend to a location remote from the circuit board. The conductor may comprise a radio-frequency waveguide.

Figure 3:
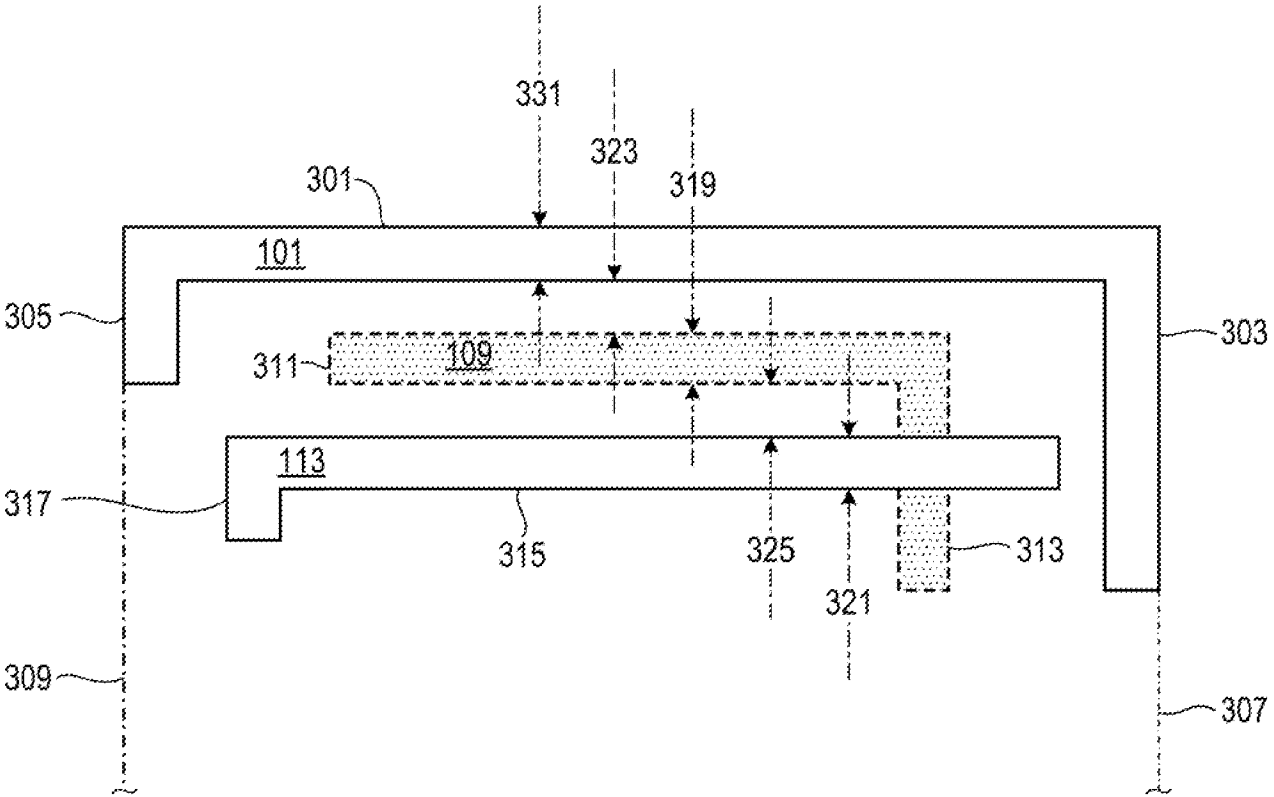
FIG. 3 is a top view of elements of the antenna of FIG. 1.

Referring to FIG. 3, the low-band ground-coupled arm 101 includes an elongated main body 301; an elongated first transverse element 303 at a first extremity of the main body, generally at right angles to the main body, terminating at the ground plane 107, and electrically connected thereto to establish the electrical connection between the ground plane and the ground-coupled arm; and an elongated second transverse element 305 at a second extremity of the main body and generally at right angles to the main body.

The main body 301 may extend substantially from a first edge 307 of the printed circuit board to an opposing second edge 309.

Figure 4:
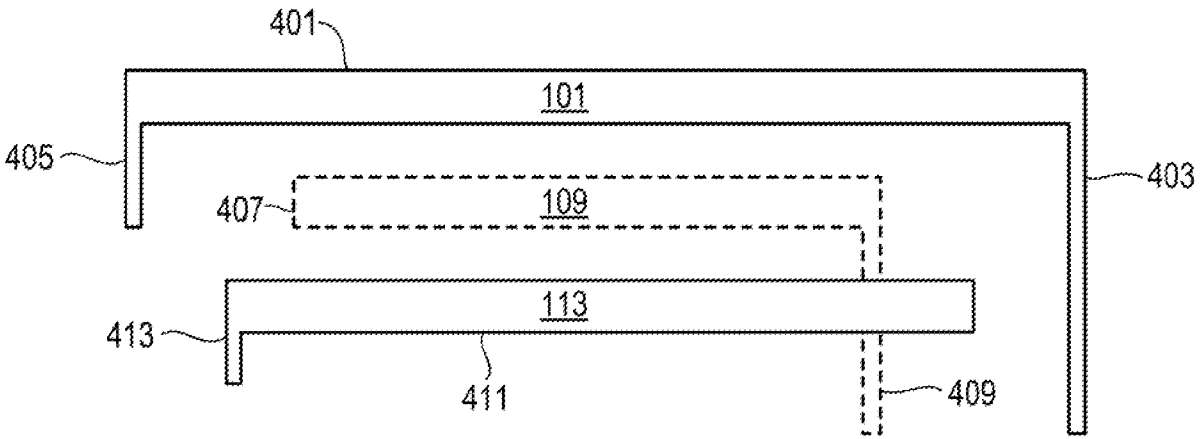
FIG. 4 is a view of elements of an antenna according to principles of the invention.

The main body may have a width 311, and the first and second transverse elements may each have substantially the same width as the main body. Or as shown in FIG. 4, the low-band ground-coupled arm 101 may have a main body 401 at least twice as wide as a first transverse element 403 or a second transverse element 405.

Dimensions may be determined by the available space in a mobile phone enclosure, or by desired frequency bands. In a prototype, the printed circuit board had overall dimensions of about 60 millimeters wide by 110 millimeters long. In this version the main body of the low-band ground-coupled arm was as long as the width of the circuit hoard, that is 60 millimeters, the first transverse element was about 11 millimeters in length and the second transverse element was about 6 millimeters in length.

The high-band ground-coupled arm 109 may comprise an elongated main body 311 and an elongated transverse element 313 at an extremity of the main body, generally at right angles to the main body, terminating at the ground plane. The transverse element 313 is electrically connected to the ground plane.

The feed arm 113 may comprise an elongated main body 315 and an elongated transverse element 317 at an extremity of the main body, generally at right angles to the main body. The transverse element 317 terminates at the conductor 115 and is electrically connected to the conductor, establishing the electrical connection between the conductor and the feed arm.

The feed arm 113 may cross over the high-band ground-coupled arm 109. These two arms are spaced apart from each other by the printed circuit board, the feed arm being disposed on the first surface 103 and the high-band ground-coupled arm 109 being disposed on the second surface 111 of the printed circuit board. The main body 315 of the feed arm crosses over the transverse element 313 of the high-band ground-coupled arm in the configuration shown in the drawings.

Figure 5:
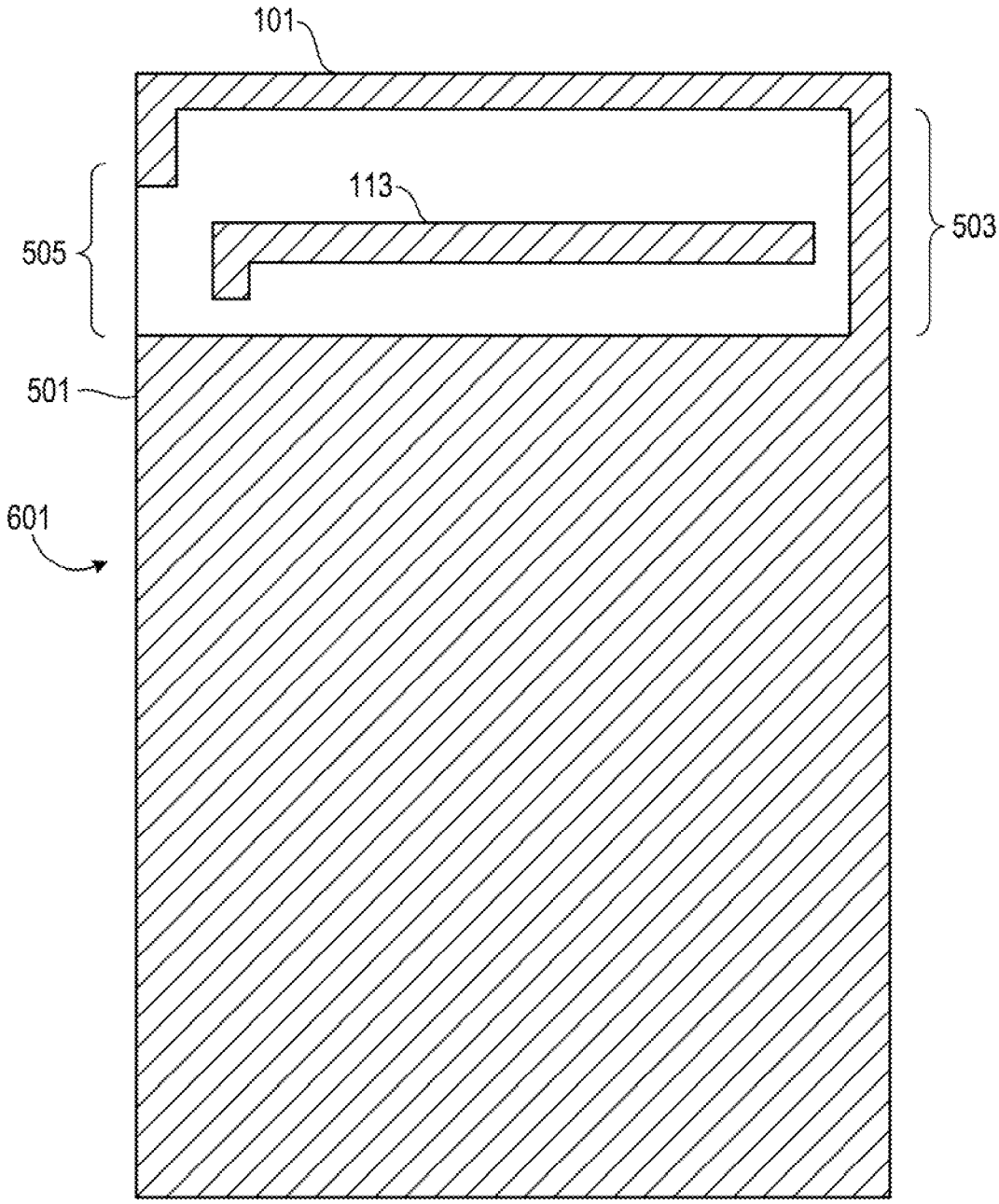
FIG. 5 is a top view of a printed circuit board with foil etched to define elements of the antenna of FIG. 1.
Figure 6:
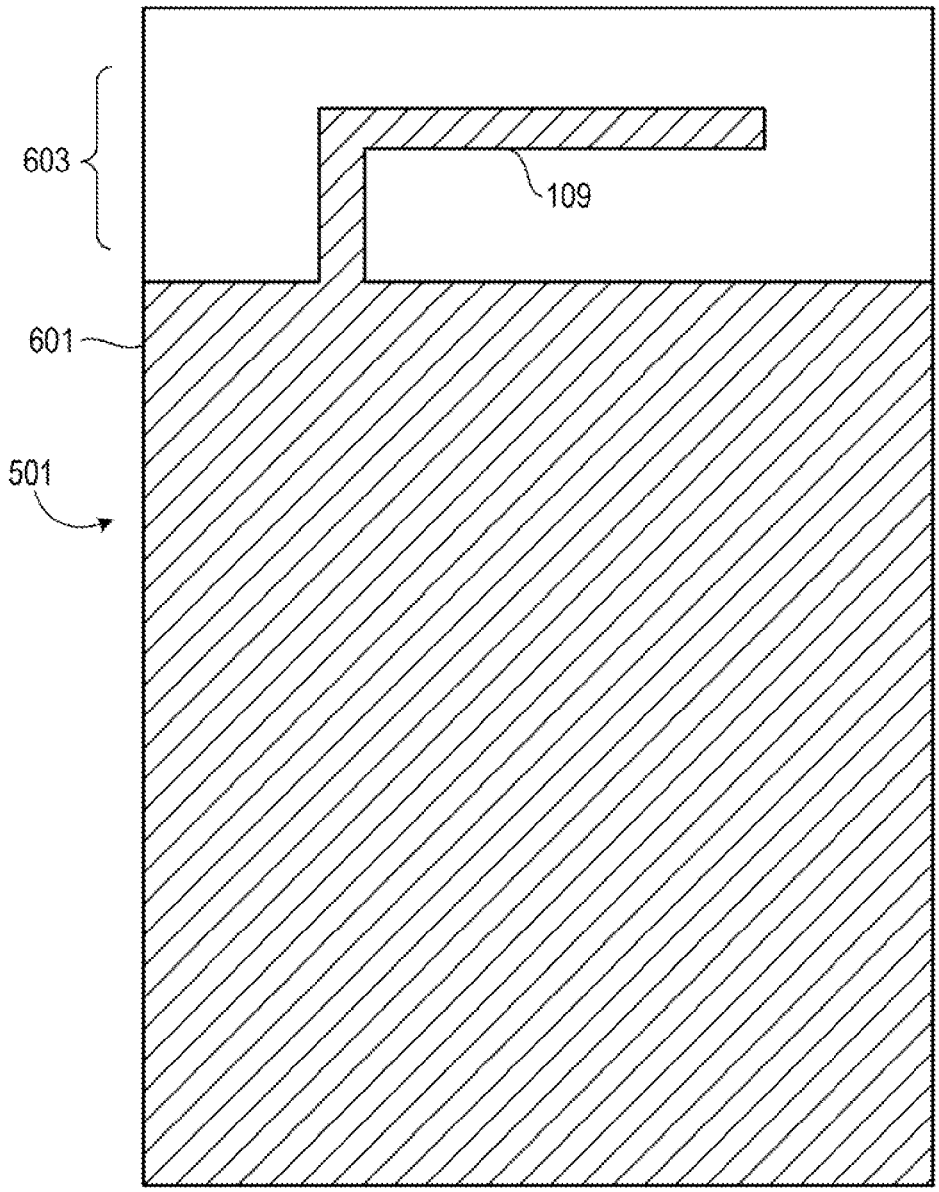
FIG. 6 is a bottom view of a printed circuit board with foil etched to define an element of the antenna of FIG. 1.

As shown in FIGS. 5 and 6, the ground plane may comprise a first sheet 501 of metal foil bonded to a first side of the printed circuit board, a second sheet 601 of metal foil bonded to a second side of the printed circuit board, and an electrically conductive path (not shown) between the first and second sheets. The low-band ground-coupled arm 101 may be formed in a portion 503 of the first sheet of metal foil, for example by etching the foil to define the arm 101.

Similarly, the feed arm 113 is formed in a portion 505 of the first sheet of metal foil that is electrically isolated from any other portion of the first sheet of metal foil, for example by etching the foil. Both arms 101 and 113 may be formed in a single etching operation as desired.

The high-band ground-coupled arm 109 may be formed in a portion 603 of the second sheet of metal foil, for example by etching the foil to define the arm 109.

Referring again to FIG. 1, an etching operation on the first surface 103 of the printed circuit board that forms the arms 101 and 113 will result in a portion 119 of the printed circuit board being bare of foil except for the arms 101 and 113. Similarly, etching the second surface 111 of the board to form the arm 109 will result in a portion 121 of the second surface being bare of foil except for the arm 109.

Turning again to FIG. 3, a width 319 of the high-band arm 109 may be substantially identical to the width 311 of the low-band arm 101. A width 321 of the feed arm 113 may also he substantially identical with the widths 311 and 319. But this is not critical, and these widths may differ from one another.

Similarly, a space 323 between the low-band arm 101 from the high-band arm 109 may be substantially identical in size to the width 311 of the low-band arm or it may differ. Also a space 325 that separates the high-band arm 109 from the feed arm 113 may be the same size as, or different than, the width 319 of the high-band arm or width 321 of the feed arm.

Turning again to FIG. 4, a main body 407 of the high-band arm 109 may be more than twice as wide as a transverse element 409. Similarly, a main body 411 of the feed arm 113 may be more than twice as wide as a transverse element 413.

Figure 7:
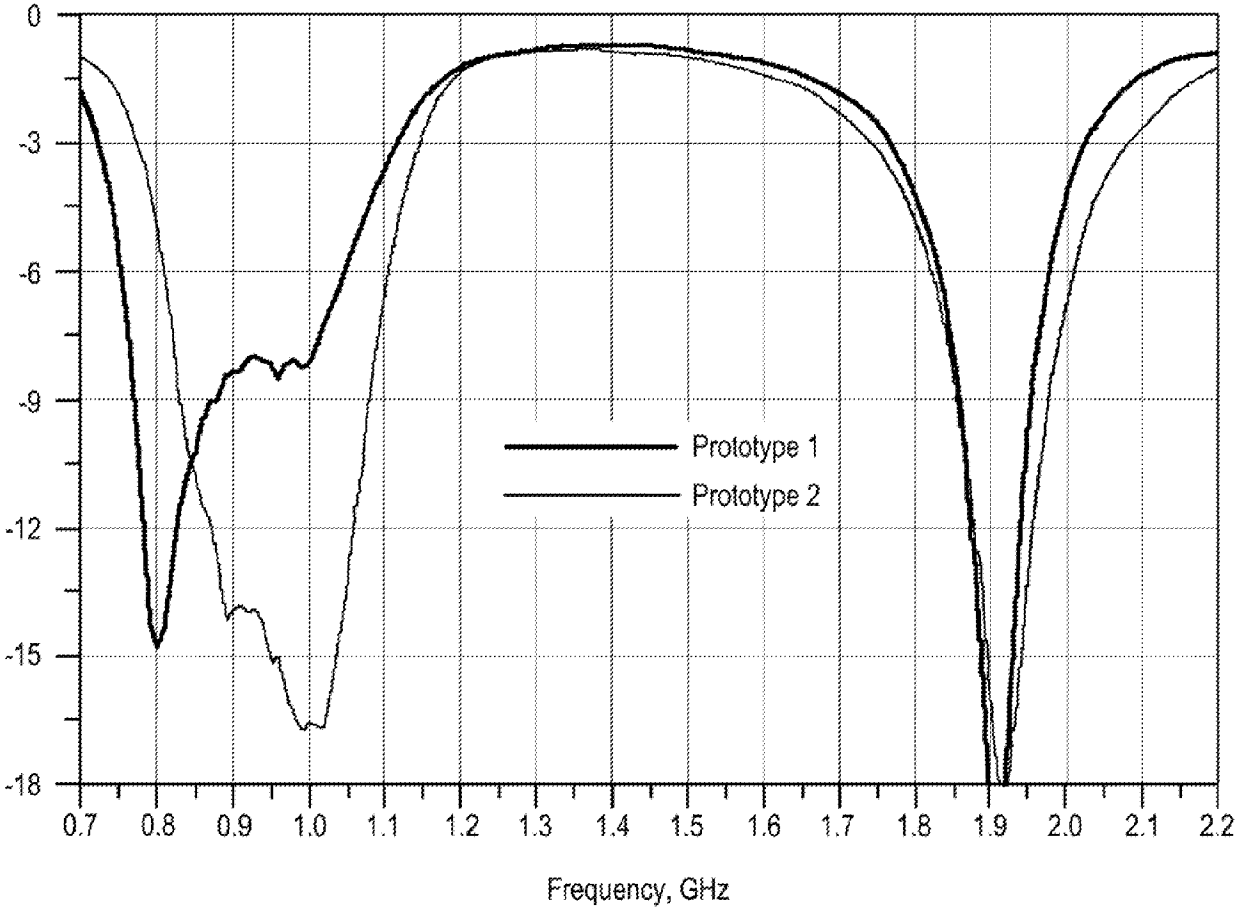
FIG. 7 is graph of an actual measurement of the return loss of two prototypes of an antenna according to principles of the invention.

FIG. 7 shows a plot of measured antenna return loss vs. frequency for two prototype antennas constructed according to principles of the invention. The plotted frequency extends from 0.7 gigahertz (GHz) to 2.2 GHz. This plot shows a wide lowband bandwidth.

Figure 8:
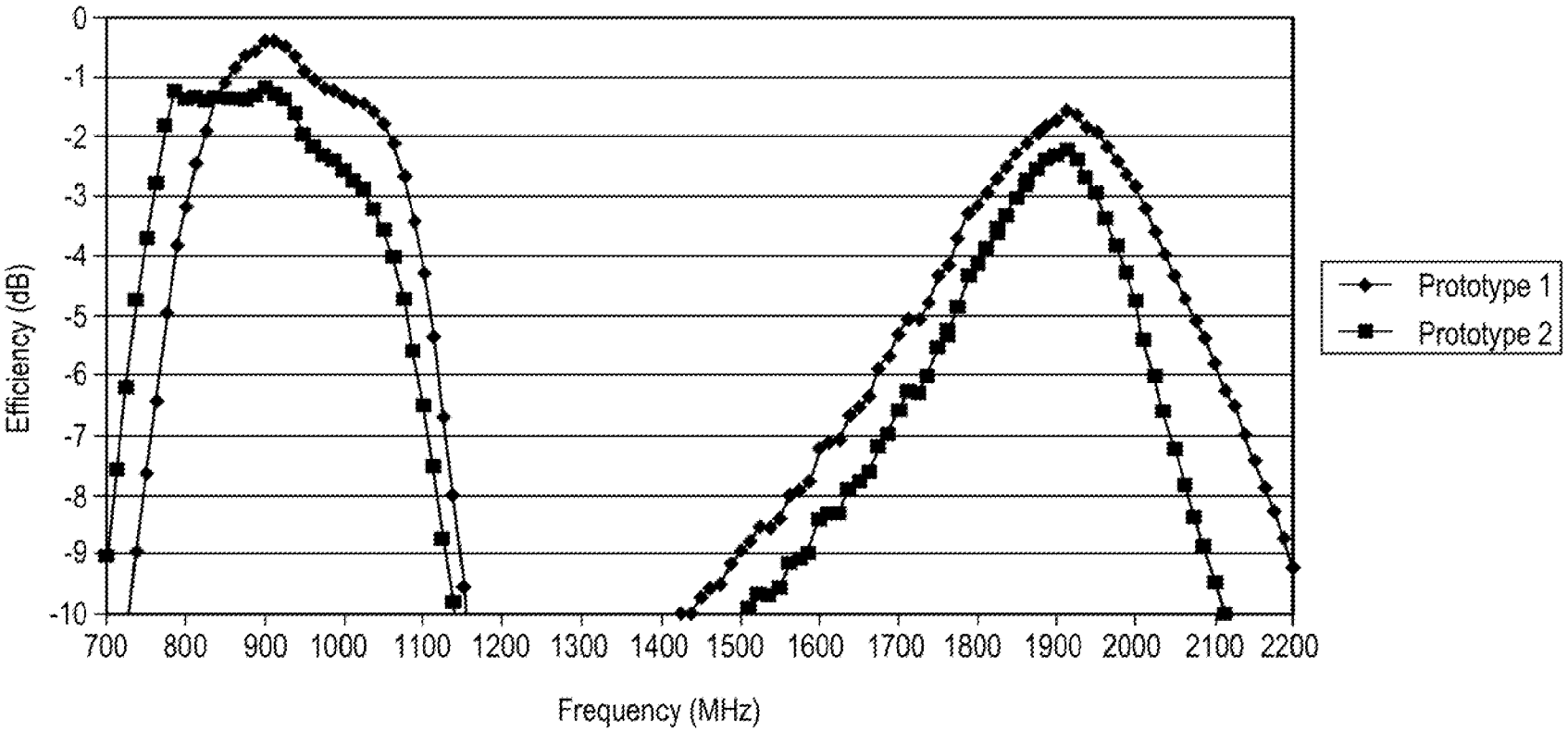
FIG. 8 is graph of an actual measurement of the efficiency of two prototypes of an antenna according to principles of the invention.

Finally, FIG. 8 shows the measured efficiency of the two prototypes plotted against frequency.

An antenna implementing principles of the invention as described above can be fabricated on a printed circuit board (FR4) and can accommodate the 700 MHz LTE bands while still covering the 0.85 GHz, 0.90 GHz, and 1.9 GHz frequency bands. The ground-coupled arms, used as part of the radiation elements, achieves multi-mode antenna resonances resulting in wide low-band bandwidth. These multi-mode resonances are achieved by capacitively coupling energy from the feed arm (driven antenna element) to the ground-coupled arms in order to re-radiate the coupled energy at the desired frequencies.

I claim:

1. A dual radiator monopole antenna comprising:

an elongated low-band ground-coupled arm disposed on a first surface of a printed circuit board, the elongated low-band ground-coupled arm (i) having a first end that is electrically connected to and extending from a ground plane, and (ii) being structured to be spaced apart from the ground plane along a portion of the elongated low-band ground-coupled arm;

an elongated high-band ground-coupled arm disposed on a second surface of the printed circuit board, the elongated high-band ground-coupled arm (i) having a first end that is electrically connected to and extending from the ground plane, and (ii) being structured to be spaced apart from the ground plane along a portion of the elongated high-band ground-coupled arm;

a feed arm disposed on the first surface of the printed circuit board, the feed arm (i) being electrically disconnected from the ground plane, and (ii) being structured to have a portion that is substantially parallel to the portion of the elongated low-band ground-coupled arm; and a conductor that is connected to the feed arm and extends from a connection point.

2. The antenna of claim 1, wherein the elongated low-band ground-coupled arm comprises:

an elongated main body;

a first transverse element extending from a first end of the elongated main body at a right angle from the elongated main body and being connected to the ground plane; and a second transverse element extending from a second end of the elongated main body at a right angle from the elongated main body.

3. The antenna of claim 2, wherein the elongated main body extends substantially from a first edge of the printed circuit board to an opposing second edge thereof.

4. The antenna of claim 3, wherein the elongated main body, the first transverse element, and the second transverse element each have substantially the same width.

5. The antenna of claim 3, wherein the width of the elongated main body is at least twice the width of at least the first transverse element or the second transverse element.

6. The antenna of claim 4, wherein the elongated main body is substantially 60 millimeters in length, the first transverse element is substantially 11 millimeters in length and the second transverse element is substantially 6 millimeters in length.

7. The antenna of claim 1, wherein the elongated high-band ground-coupled arm comprises (i) an elongated main body, and (ii) a transverse element extending from a first end of the elongated main body at a right angle from the elongated main body and being connected to the ground plane.

8. The antenna of claim 7, wherein the feed arm comprises (i) an elongated main body, and (ii) a transverse element extending from a first end of the elongated main body at a right angle from the elongated main body and being connected to the conductor.

9. The antenna of claim 8, wherein the elongated main body of the feed arm is positioned on the surface of the printed circuit board so that the elongated main body of the feed arm crosses over at least a portion of the elongated high-band ground-coupled arm, the feed arm and the elongated high-band ground-coupled arm being spaced apart from each other by the printed circuit board.

10. The antenna of claim 9, wherein the elongated main body of the feed arm crosses over the transverse element of the elongated high-band ground-coupled arm.

11. The antenna of claim 1, wherein the conductor comprises a radio-frequency waveguide.

12. The antenna of claim 1, wherein the ground plane comprises a first sheet of metal foil bonded to a first side of the printed circuit board, a second sheet of metal foil bonded to a second side of the printed circuit board, and an electrically conductive path between the first and second sheets.

13. The antenna of claim 12, wherein the elongated low-band ground-coupled arm is formed in a first portion of the first sheet of metal foil.

14. The antenna of claim 13, wherein the feed arm is formed in a second portion of the first sheet of metal foil that is electrically isolated from any other portion of the first sheet of metal foil.

15. The antenna of claim 12, wherein the elongated high-band ground-coupled arm is formed in a first portion of the second sheet of metal foil.

16. An antenna assembly comprising:

a first radiating arm disposed on a first surface of a printed circuit board, the first radiating arm (i) having a first end that is electrically connected to and extending from a ground plane, and (ii) being structured to be spaced apart from the ground plane along a portion of the first radiating arm;

a second radiating arm disposed on a second surface of the printed circuit board, the second radiating arm (i) having a first end that is electrically connected to and extending from the ground plane, and (ii) being structured to be spaced apart from the ground plane along a portion of the second radiating arm;

a feed arm disposed on the first surface of the printed circuit board, the feed arm (i) being electrically disconnected from the ground plane, and (ii) being structured to have a portion that is substantially parallel to the portion of the first radiating arm; and a conductor that is connected to the feed arm and extends from a connection point;

wherein the ground plane comprises a first sheet of metal foil bonded to a first side of the printed circuit board, a second sheet of metal foil bonded to a second side of the printed circuit board, and an electrically conductive path between the first and second sheets.

17. The antenna assembly of claim 16, wherein the first radiating arm comprises:

a main body;

a first transverse element extending from a first end of the main body at a right angle from the main body and being connected to the ground plane; and a second transverse element extending from a second end of the main body at a right angle from the main body.

18. The antenna assembly of claim 17, wherein the main body extends substantially from a first edge of the printed circuit board to an opposing second edge thereof.

19. The antenna assembly of claim 16, wherein the second radiating arm comprises (i) a main body, and (ii) a transverse element extending from a first end of the main body at a right angle from the main body and being connected to the ground plane.

20. The antenna assembly of claim 19, wherein the feed arm comprises (i) a main body, and (ii) a transverse element extending from a first end of the main body at a right angle from the main body and being connected to the conductor.

* * * * *